US005411433A

United States Patent [19]

Keller

[11] Patent Number: 5,411,433

[45] Date of Patent: May 2, 1995

[54] DUST-COLLECTING APPARATUS

[75] Inventor: Robert L. Keller, Tonawanda, N.Y.

[73] Assignee: Dynabrade, Inc., Clarence, N.Y.

[21] Appl. No.: 258,840

[22] Filed: Jun. 13, 1994

[51] Int. Cl.[6] ..... B24B 55/02

[52] U.S. Cl. ..... 451/451; 451/452; 451/453

[58] Field of Search ..... 451/451, 452, 453, 455, 451/456, 144; 30/124, 390; 83/100, 544

[56] References Cited

U.S. PATENT DOCUMENTS

| | | | |
|---|---|---|---|
| 2,913,926 | 11/1959 | Hammond | 451/451 |
| 3,468,076 | 9/1969 | Jones | 451/451 |
| 3,673,744 | 7/1972 | Oimoen | 451/451 |
| 4,059,930 | 11/1977 | Alessio | 451/451 |
| 5,005,321 | 4/1991 | Barth et al. | 451/451 |

*Primary Examiner*—Bruce M. Kisliuk
*Assistant Examiner*—Derris H. Banks
*Attorney, Agent, or Firm*—James J. Ralabate

[57] ABSTRACT

The shield of this invention has a skirt that is tilted or slanted forward which, together with longer bristles, provides a substantial improvement in these type devices. Also provided in the shield of this invention is an adjustable, slanted clamp that can be adapted for connection to various size sanders. A baffle is also included within the shield to form a tunnel effect which enhances suctioning or vacuuming off of debris resulting from the sanding operation.

18 Claims, 8 Drawing Sheets

DUST-COLLECTING APPARATUS

This invention relates to a grinding or sanding apparatus and, more particularly, to a novel dust shield and debris-collecting and containment structure.

BACKGROUND OF THE INVENTION

It is known to use powered portable sanders or grinders utilizing flexible, abrasive grinding discs, These sanders can be used for finishing a plurality of surfaces such as wood, metal, plastic or other materials, When used, the discs generate upon surface contact a considerable amount of dust and debris made up mostly of the material being sanded, Such materials, especially some toxic plastics, if not controlled to an extent, could cause a serious health problem to the operator, There have been many structures designed to protect the operator from body contact with the residual dust particles which are generated during the sanding or grinding operation. Most of these apparatuses contain vacuuming equipment or components to immediately remove the dust or debris as it is generated by the disc, Thus, these powered, sanding apparatuses require protective shields or components for the collection and containment of dust and particulate matter generated during the sanding or grinding operation, Some of these aparatuses are disclosed in U.S. Pat. Nos. 3,882,644; 4,422,239; 4,616,449; 4,622,782; 4,624,078; 4,765,099 and 5,125,190, In U.S. Pat. No. 3,882,644 (Cusumano) a dust-extracting device is disclosed having a vacuum or suction conduit with a brush guard encircling its sander disc. The Cusumano apparatus is similar to those that have been used in the prior art. The brush used by Cusumano is connected to his truncated, circular hood by the use of material connecting strips which are secured outside the sander skirt. The brush guard and arcuate skirt surrounding his sanding disc are conveniently used components that assist the vacuuming of generated dust particles. The plane level of the hood roof 28 and ring clamp of Cusumano's structure are above and substantially parallel with the lower contact surfaces of his bristles 68. This feature could permit the escape of debris from under the bristles when the sander is press-tilted forward during the sanding operation.

In U.S. Pat. No. 4,422,239 (Maier et al) a powered handtool is disclosed having suction means 100. His suction means are designed running from the cover into and through the housing so that there are no flexible pipes joined up with the cover. Maier does not show a brush skirt to be used with his handtool.

Roestenberg, in his U.S. Pat. No. 4,622,782, discloses a sander shield having a plurality of vacuum holes each connected to one end of a vacuum hose and vacuum pump. In this manner, Roestenberg can reach every part of the interior of his sander as the dust is generated. Roestenberg does not utilize a brush skirt or brush shield.

In U.S. Pat. No. 4,624,078 (Van Rijen) a surface sander is disclosed having a dual dust hood enclosing the motor housing. The dust collector hood of Van Rijen acts as both a receptacle for dust extraction and as a mounting means. A flesible skirt 21 is fastened to the lower rim of Van Rijen's apparatus. However, by extracting dust particles through holes 53, his skirt 21 may be dispensed with.

Marton, U.S. Pat. No. 4,616,449, discloses in his patent a suction housing for vacuum sanding devices. The suction plate is formed of a relatively flexible plastic material. A flexible skirt is also used by Marton to assist in removing or collecting process-generated dust from the situs.

In U.S. Pat. No. 4,765,099 (Tanner) a sanding and dust-collecting apparatus is disclosed which allows collection of dust residue without the requirement of vacuum equipment. Tanner uses a one-piece brush assembly 20 which forms a flexible dust containment curtain about the sanding disc assembly 50. The brush assembly 50 of Tanner's device is constructed so that its upper end portion 94 is parallel with the terminal ends 52 of brush 22.

In Buser, U.S. Pat. No. 5,125,190, a shield attachment for fitting on a rotating grinder is provided which shields the rotating disc. Buser's shield provides a tangential exhaust port for exhausting dust in moving air created by the rotating disc. Buser's hood 10 is generally constructed of molded plastic or fiberglass and has a lower circular edge portion 26 that is in a single plane substantially parallel with the upper surface 20 of the shield.

In all of the above prior art units, the collars or ring attachments that connect a shield or skirt to the sander structure are generally of one size and thus are suitable only for one size sander. Also, the lower terminal end of prior art shields, whether bristles or other flexible means, are substantially parallel with the ring attachments and the upper roof section of the shields. This type shield construction could readily cause the shield to lift above the grinding plane at a location opposite to the locus of the exerted pressure. Any space between the shield and the surface being sanded could permit significant amounts of dust and debris to escape to the atmosphere and expose the user to substantial safety problems, in particular when sanding toxic surfaces.

SUMMARY OF THE INVENTION

It is therefore an object of this invention to provide a shield for a portable disc sander that is devoid of the above-noted disadvantages.

Another object of this invention is to provide a shield that can be used with a variety of sanders having differing component dimensions.

Yet another object of this invention is to provide a shield that will substantially minimize the space difference between the lower shield and the surface being sanded.

Still a further object of this invention is to provide a brush shield component with interchangeable sections that will prolong the useful life of the component.

Another yet further object of this invention is to provide a shield that can be effectively used with a vacuum suction structure to more efficiently remove dust and debris from the locus of a grinding or sanding operation.

Another still further object of this invention is to provide a shield that is unobviously efficient, relatively simple in construction and comparatively economical to manufacture.

These and other objects of this invention are accomplished by a novel shield for sanding tools (and, when appropriate, grinding tools) that is constructed to enhance the protection of the user against resulting dust and debris. A critical feature of the present invention involves the use of a ring attachment component that is pitched away from the locus of the shield where maximum pressure is exerted. In other words, the ring attachment has a downward slant from the back to the front section of the shield. The "front" being the forward section of the sander and shield section farthest from the user, the "back" being that section closest to the user. The incline should be at least five degrees sloping downward and forward from the back section as shown in the drawings of this disclosure. The preferred roof or ring attachment slope is about 15 degrees for best results and optimum dust protection, however, it can vary from any slant above five degrees from horizontal. By "horizontal" is meant, if a line was drawn above and parallel with an even and flat surface to be treated, that would be "horizontal", i.e. being in a plane parallel to the plane of the horizontal. Therefore, the shield roof or ring attachment in the present invention thus is not parallel to the surface to be treated as in the prior art but rather provides with this surface a greater than 5° deviation from horizontal. The roof or ring attachment also is parallel with the pad but not parallel with the surface to be treated. The angle deviation of at least 5° or angle slant defines the angle closest to the front of the sander. Also critical to the invention is the use in some embodiments of an adjustable ring clamp to provide for use of this shield with a plurality of size sanders. Another important feature of the present invention is the use of a baffle in the interior of the shield which forms a tunnel feature that enhances movement of the dust and debris toward the vacuum section inlet means. To enhance the suction effect besides the use of a baffle, the vacuum inlet is located at a greater distance (increase radius) from the edge of the sanding disc and disc arbor. This feature is important since it allows for the increased collection of debris and dust at the periphery of the disc. In sanders where the vacuum inlet is located closer to the edge of the sanding disc the undesirable effect of the debris action at the periphery of the disc will be centrifugally thrown out away from the vacuum suction zone causing very little or poor collection of dust particles. Another desirable feature of the present invention is the use of two or more identical brush assemblies to allow the operator or user to switch brush assembly locations after normal wear of one or more of the assemblies. This permits easy interchanging of the brush assemblies without having to order and wait for new brush assemblies when one or more become worn, deformed or shortened because of use. The brush bristles are preferably longer than prior shield bristles to ensure maximum coverage when the sander is used in extreme inclined positions. The bristles therefore on the guard-skirt of the present invention extend further below the plane of the sander disc than previously provided.

BRIEF DESCRIPTION OF THE DRAWINGS

FIG. 5 is a perspective detached side view showing the shield of this invention and sander that it will attach to.

DETAILED DESCRIPTION OF THE DRAWINGS AND PREFERRED EMBODIMENTS

Figure 1:
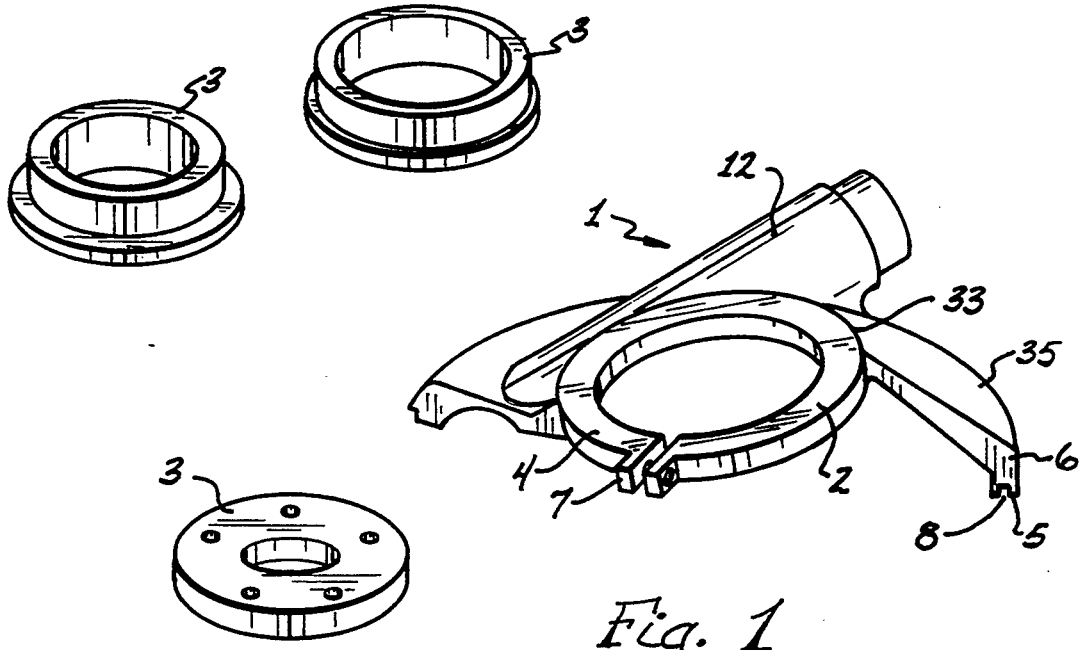
FIG. 1 is a side perspective view of the shield of this invention with its adjustable enlarged ring clamp-adapter and where the ring clamp is tilted downward not parallel with its skirt.
Figure 2:
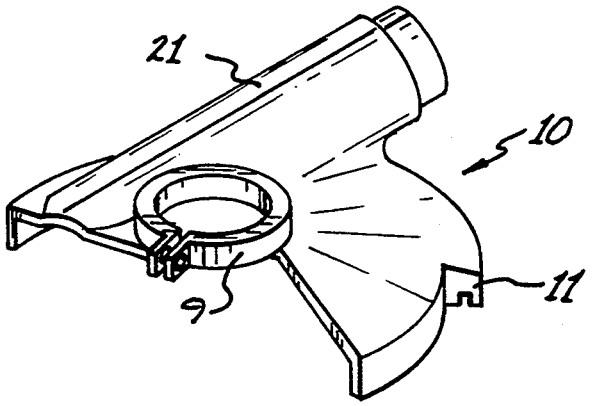
Fig. 2 Prior Art
FIG. 2 is a side perspective view of a prior art shield with the much smaller ring clamp and ring clamp parallel with the bottom of its skirt.
Figure 11:
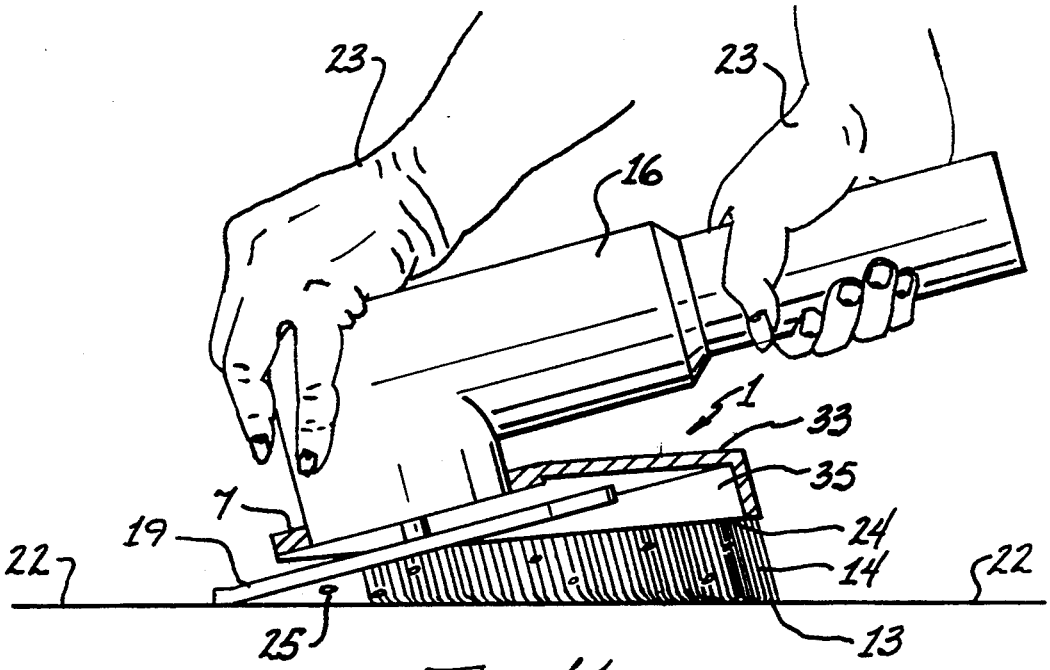
FIG. 11 is a side plan view of the shield of this invention illustrating the improved bristle coverage provided by the present invention.
Figure 15:
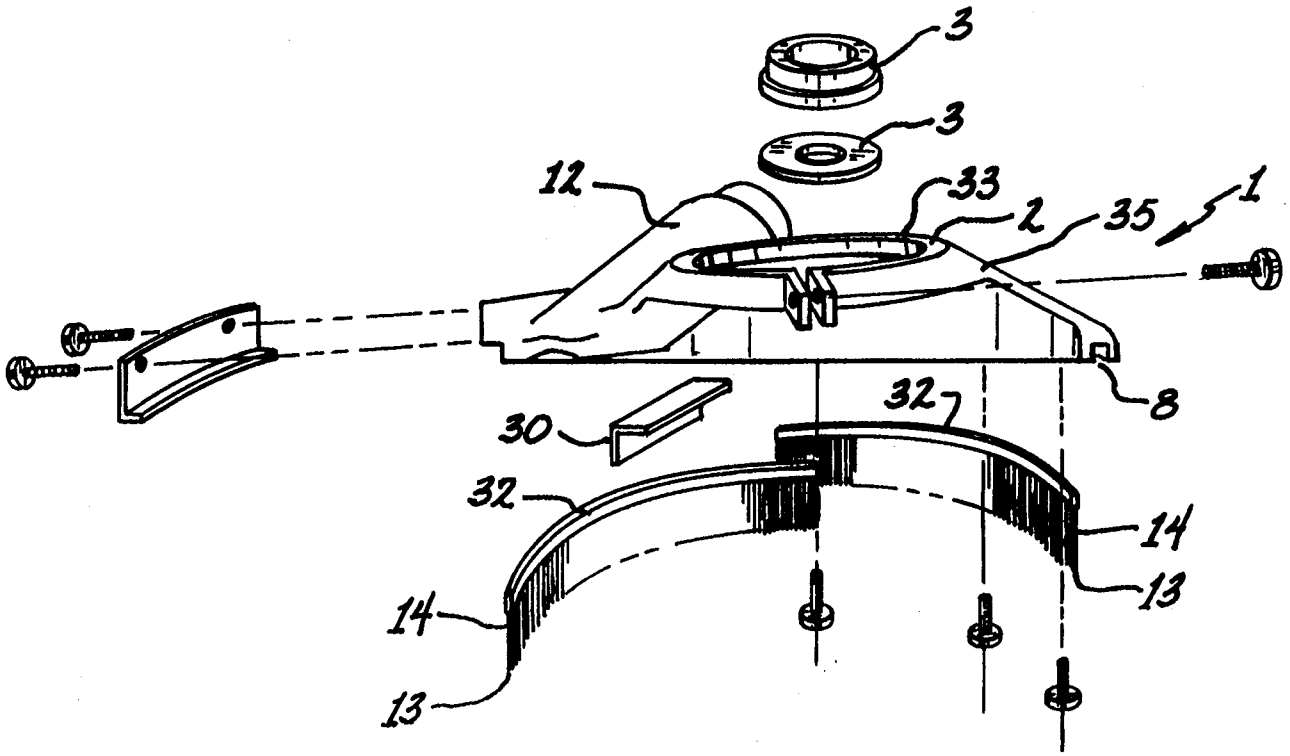
FIG. 15 is an exploded view of the components used in the shield of this invention.

In FIG. 1 the shield 1 of this invention is illustrated showing the enlarged ring clamp 2 which can be used with adapters 3 to fit a variety or styles of sanders or grinders. The term "enlarged ring" means throughout this disclosure a ring clamp substantially larger than used heretofore in the prior art as shown in FIG. 2. The ring clamp 2 (or roof 35 of shield 1) tapers or is slanted downward from back portion 33 to front portion 4 thereby not being parallel with the bottom 5 of skirt 6. Also, this slanted clamp 2 would not be parallel to the surface 22 (as shown in FIG. 11) to be treated but rather the front of shield 1 forms at least a 5° angle with the plane of surface 22. A roof clamp 2 angle of about 5°–30° with surface 22 is preferred. The enlarged ring or roof clamp 2 has an adjusting means 7 for tightening or loosening the clamp 2 around the various adapters 3. A slot 8 is located throughout the entire bottom 5 of skirt 6 to receive brush assemblies (as shown in FIG. 15). An arrow feature is provided on the roof 35 to indicate ideal action area for treating the surface and directing the sander for optimum vacuum results. In FIG. 2 a typical prior art shield 10 is shown with a ring clamp 9 parallel with skirt bottom 11 and with a ring clamp 9 of much smaller diameter than required in the present invention. Only a limited number of different size sanders can be used with prior art shields because of the small size. The downward slant of the ring clamp 2 and roof 35 of the present invention provides means for substantially improved brush coverage of the gap between the brush bottoms and the surface being sanded. The improved shield of this invention is useful on abrading machines, as a dust-extracting device for any tool or a shield for the sanding and/or grinding portion of a powered handtool.

Figure 3:
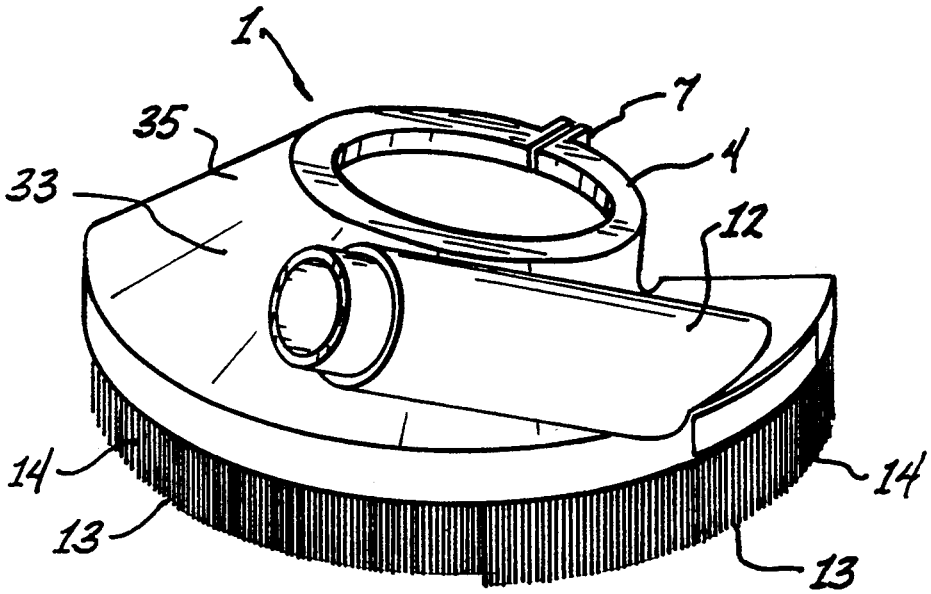
FIG. 3 is an opposite side perspective view of the shield of this invention, again illustrating the back to front downward incline of the ring clamp which is not parallel with the bottom of the bristles.
Figure 4:
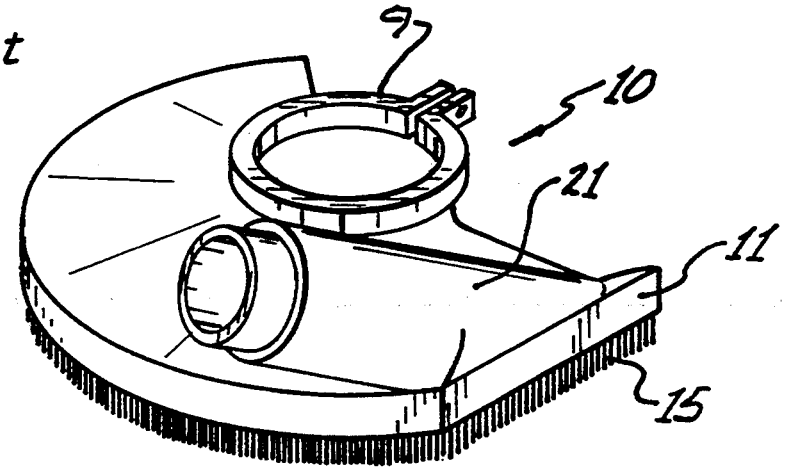
Fig. 4 Prior Art
FIG. 4 is an opposite side perspective of a prior art shield where the plane of the ring clamp is parallel with the plane of the bottom of the bristles.

In FIG. 3 an opposite side view (from FIG. 1) of the shield 1 of this invention is illustrated. In FIG. 3 the vacuum suction conduit 12 is in the foreground as the shield 1 faces forward. The incline of ring clamp 2 and roof 35 is clearly shown on a plane not parallel with but rather off about 10° from the level plane of the bottom 13 of bristles 14. Also shown in FIG. 3 are the longer bristles 14 (longer than prior art bristles) as compared with the short bristles 15 of a typical prior art unit 10 of FIG. 4. The longer bristles 14 together with the downward tilt of ring clamp 2 (or shield roof) provide excellent bristle coverage of the gap or distance between the rear bristle bottoms 13 and the surface being sanded. Note, the substantially parallel configuration of prior art ring clamp 9 to the plane of the bristle bottoms 15.

Figure 5:
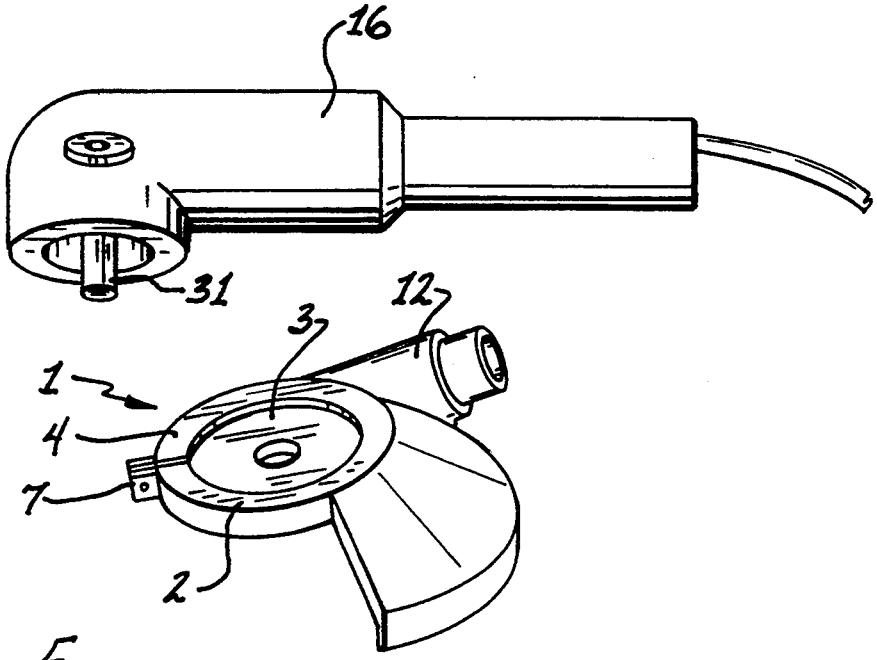
Figure 6:
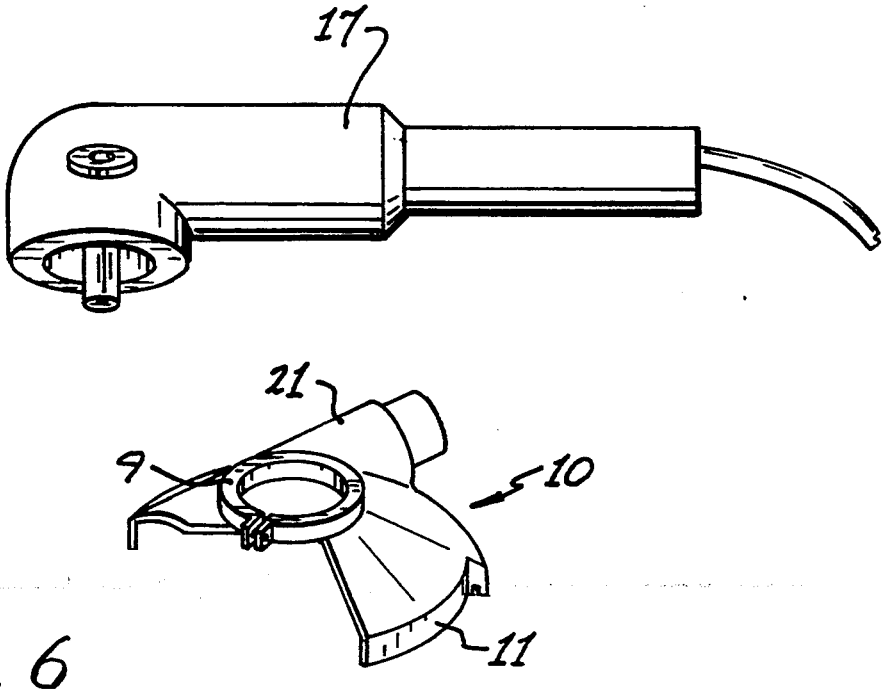
Fig. 6 Prior Art
FIG. 6 illustrates a prior art shield and a sander to which it will attach.
Figure 9:
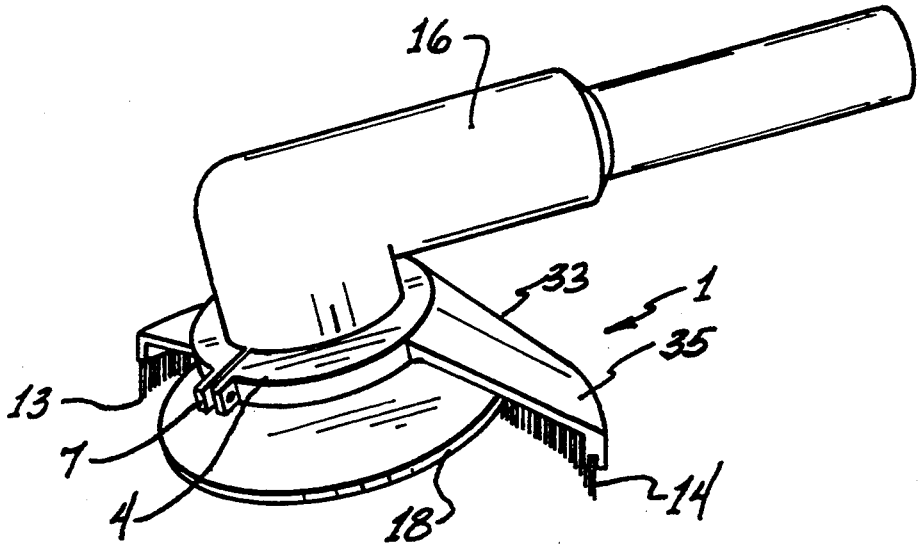
FIG. 9 is a side perspective view of the shield of this invention attached to a sander and the forward tilt of the shield.

FIG. 5 shows a sander 16 prior to connection to shield 1 wherein FIG. 9 shows shield 1 connected to sander 16. The downward tilt of connecting ring clamp 2 is illustrated showing the position sander 16 and shield 1 will assume upon being connected. Compare the downward slant of roof 35 of shield 1 of the present invention (when connected to sander 16) to the level position of prior art shield 10 when it is connected to sander 17 as shown in FIG. 6. Again, note the parallel configuration of ring clamp 9 to skirt bottom 11 of the prior art device.

Figure 7:
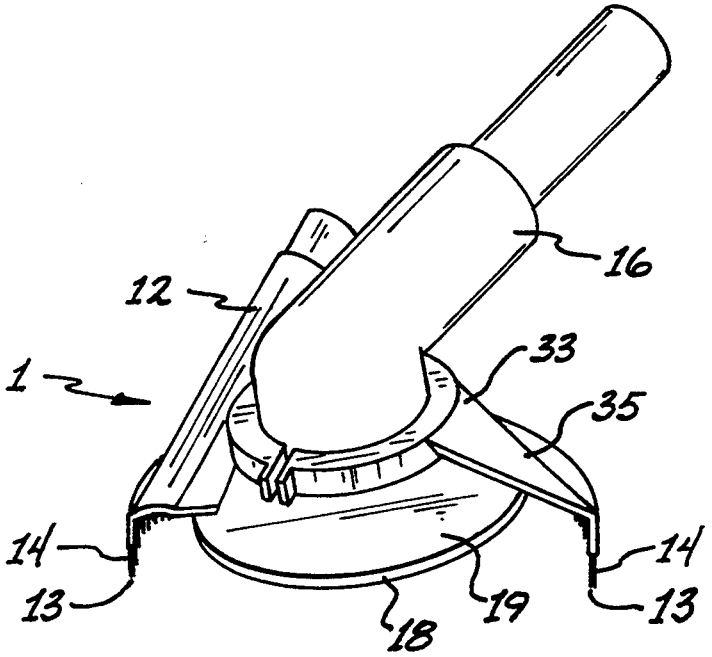
FIG. 7 is a front perspective of the shield of this invention and the increased radius distance of the suction inlet from the disc.

In FIG. 7 the shield 1 of this invention is shown connected to a sander 16 where the suction inlet 12 is positioned at a greater distance from the edge 18 of backup pad 19. This is important because the debris created by the sanding action is being centrifugally thrown from the edge 18 of pad 19 and therefore mechanically trapped by vacuum suction conduit 12 and bristles 14. Also, the forward tilt of the roof 35 of the shield 1 can be seen providing better back bristle coverage from the surface being sanded. The pressure on the pad 19 will be forward thus the back section of the shield will normally be higher thereby leaving a space between the back of the shield and the surface being treated. The longer bristles 14 and the angle of the ring clamp connector 2 provide sufficient means to close this space. The shield has an open front portion to allow the user to see the surface being treated. Any size epen front portion can be used depending upon the style or configuration of the sander 16, etc.

Figure 8:
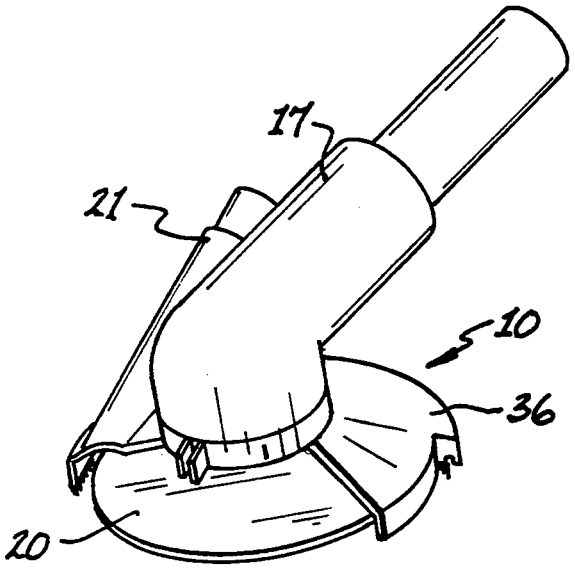
Fig. 8 Prior Art
FIG. 8 is a front perspective of a prior art shield showing the level or even configuration of prior art shield roofs.

In FIG. 8 in the prior art, the shorter bristles 15 are clearly illustrated. Also, the level positioning of the roof 36 of shield 10 in the prior art will normally result in a back bristle to surface space being formed or caused when the sander 17 is pressed forward upon the sanding or grinding operation. Also, the smaller less adaptable ring clamp 9 can be seen in this FIG. 8.

Figure 10:
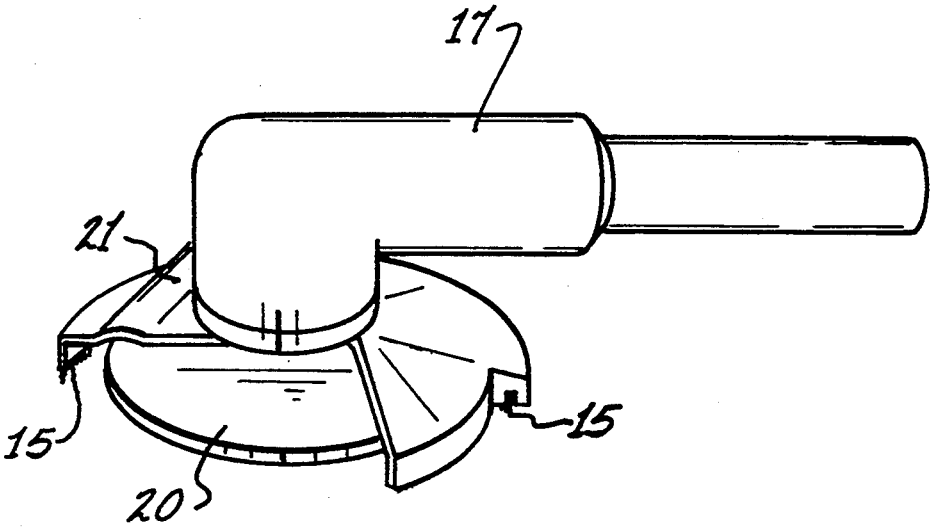
Fig. 10 Prior Art
FIG. 10 is a side perspective view of a typical prior art shield where the ring clamp is parallel with the bristle bottoms.

In FIG. 9 a side perspective of the connected shield 1 of the present invention and sander 16 is shown. The forward tilt of this unit is shown resulting from the inclined angle of the connector ring clamp 2 and shield roof 35. Clearly shown in this figure are the longer bristles 14 which assist in space coverage (from bristles to treated surface) during use. Both the angle incline of connector clamp 2 and longer bristles 14 result in excellent bristle to surface space coverage. In comparison, in FIG. 10, the prior art level connector (parallel with bristle 15) and the shorter bristles 15 normally will result in a space in back of the shield when the sander and disc are pressed forward during operation.

Figure 12:
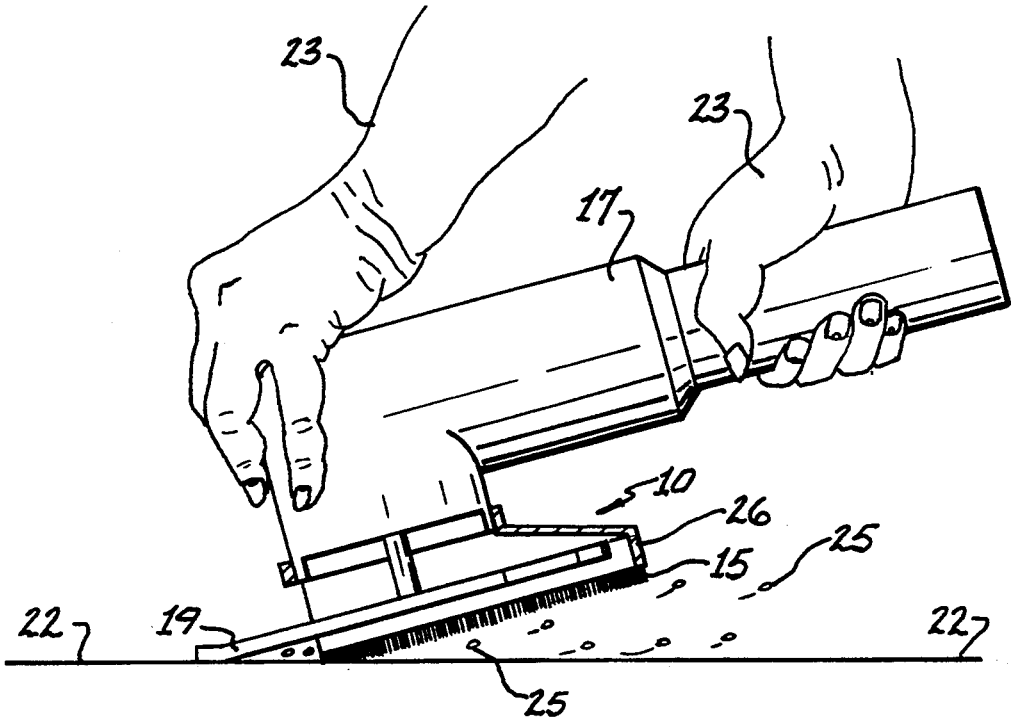
FIG. 12 is a side plan view of a typical prior art shield and the limited bristle back coverage.

In FIG. 11 the sander 16 with shield 1 is shown in use on a treated surface 22. As the sander 16 is being pressed forward by user 23, a gap or space would normally occur between bristle ends 13 and the surface 22. Instead, because of the tilted shield and longer bristles 14, no space occurs in the back bottom portion 13 of bristles 14 between the surface 22 being treated and the bottoms 13 of bristles 14. A much greater latitude is provided the user, and much less debris dust 25 can escape caused by the grinding pad 19 contacting the surface 22. In prior art devices as in figure 12, when the user 23 presses forward on sander 17 the shield 10 is lifted in the back 26 causing debris 25 to escape from the shield 10 confines. This could cause a health problem to users especially when grinding or sanding of any toxic surfaces 22. The prior art drawbacks therefore are parallel shield connecting means or ring clamp and roof (to sander) being substantially parallel with their bristles 15 and having shorter bristles 15 which cannot make up the space difference caused by pressing forward of the sander 17 during use.

Figure 13:
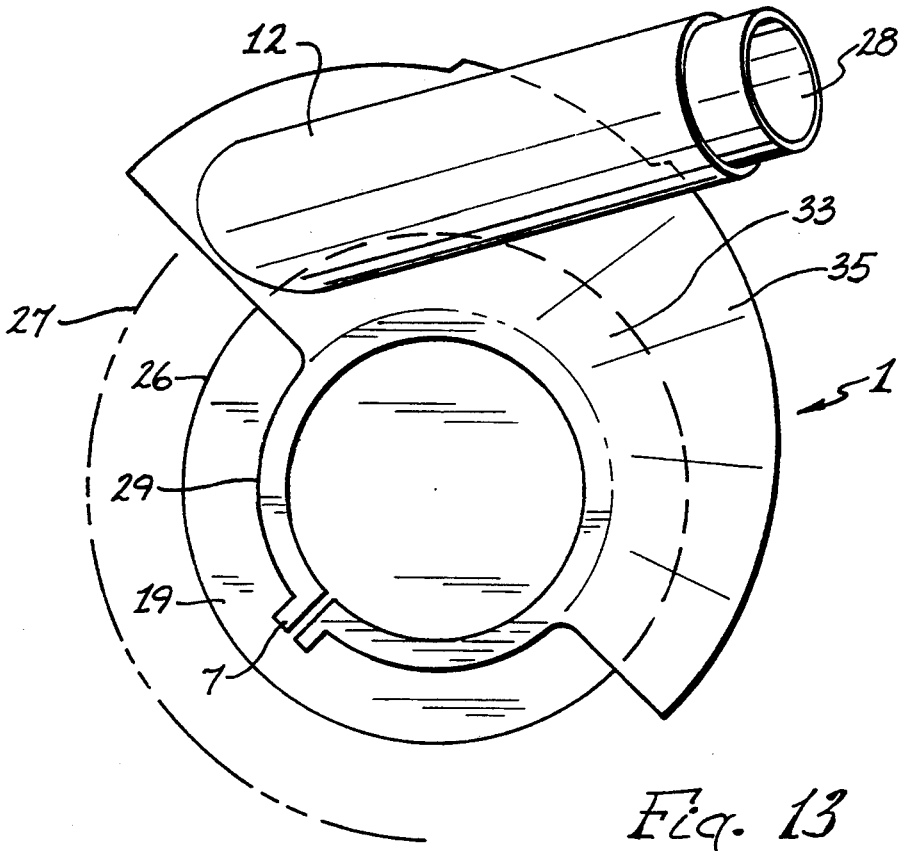
FIG. 13 is a top schematic view of the present invention showing the increased distance of the suction inlet from the disc edge.

FIG. 13 is a schematic top view showing the increased distance of the pad 19 from the intake of vacuum inlet 12. The edge 26 of pad 19 has a substantially increased distance from the radii 27 of vacuum inlet 12. The vacuum inlet terminates at its upper end 28 to a vacuum pump or other suction means. The shield 1 has an adequate open front section 29 to provide proper viewing of the surface 22 to pad 19 contact.

Figure 14:
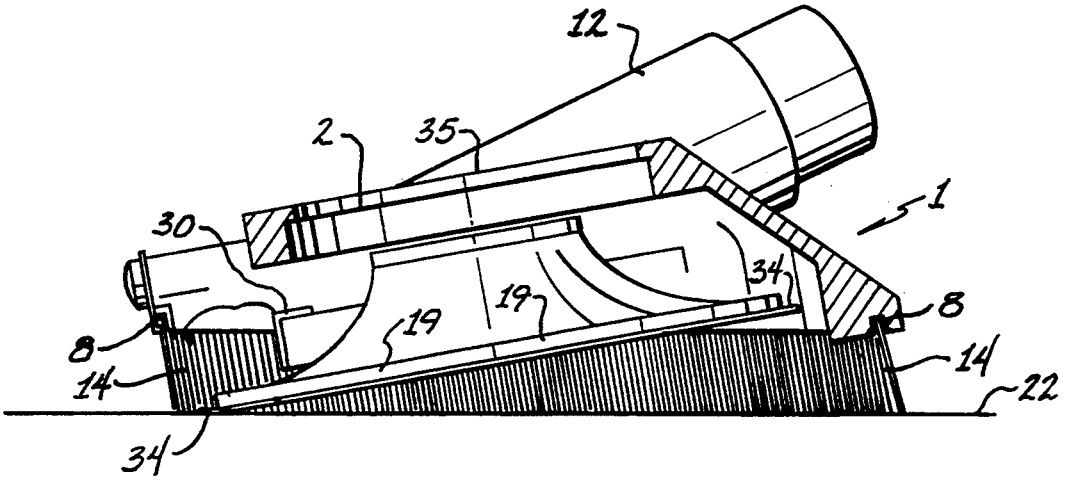
FIG. 14 is a side schematic view of the present invention showing the location of the baffle used in the shield of this invention.

In FIG. 14 a critical feature of the present invention is shown, that being a baffle 30 positioned inside the shield 1 at a location between the vacuum inlet 12, the bristles 14 and the back up pad 19 (together with abrasive disc 34) thereby providing a tunnel feature which substantially enhances the suction action for the debris from surface 22 to be carried up and away into the vacuum inlet. Note the forward slant of the shield 1, lower in front and higher in back which is clearly shown in FIG. 14.

In summary, the novel shield 1 of the present invention has critical features that provide a vastly improved function. These features are, as described heretofore and as shown in FIG. 15: A. the tilted ring clamp 2 and roof 35 that results in a lower shield front profile and reduces substantially any space in the back of the shield 1 during usage; B. the longer brush bristles 14 that assist in space reduction and maintain debris within the shield 1; C. duplicate structure and size brush assemblies 32 that can be easily interchanged when one becomes worn; D. the larger and tilted ring clamp 2 that can accommodate connection to various size adapters 3 and sanders 16; E. a baffle 30 that enhances suctioning of debris from the interior of shield ; and F. a greater distance from the disc edge 26 to the vacuum inlet 12. All of these features result in a vastly improved shield that provides a substantial improvement over the prior art. FIG. 15 also shows various screws and other attachment means used.

The preferred and optimumly preferred embodiments of the present invention have been described herein and shown in the accompanying drawing to illustrate the underlying principles of the invention but it is to be understood that numerous modifications and ramifications may be made without departing from the spirit and scope of this invention. For example, while about a 15° slant from horizontal is preferred for the clamp, any slant above 5° would be within the spirit of this invention.

What is claimed is:

1. A shield for an abrading machine comprising a roof portion and a substantially continuous skirt portion, said skirt portion structured to encircle at least a portion of an abrading disc having a rotating arbor, said rotating abrading disc having means to cause movement of debris in said shield, said roof portion having a ring clamp connecting means which has adjusting means and has a relatively large diameter and is positioned at an angle to and not parallel with a plane of a lower circular edge of said skirt, an exhaust suction conduit extending through said roof portion from within said skirt to a vacuum exhaust source, and said skirt having a lower circular edge for containing at least one flexible surface contact means.

2. The shield of claim 1 wherein said ring clamp inclines downwardly from a horizontal plane at an angle of from 5° to 30°.

3. The shield of claim 1 wherein said flexible surface contact means are at least two identical brush assemblies having substantially longer bristles for additional space coverage and protection against disc-generated debris.

4. The shield of claim 1 wherein said shield has an open front skirt portion for viewing a surface to disc contact, and a partial circular skirt portion encircling a portion of said abrading disc, said partial circular skirt portion having means to hold interchangeable brush assemblies that provide increased protection against debris escaping from the interior of said shield.

5. The shield of claim 1 wherein said shield contains a baffle extending downwardly from an interior portion of said shield at a location between said arbor back up pad and said exhaust suction conduit, said baffle forming a tunnel-like conduit to better transport debris from said disc to said exhaust suction conduit.

6. The shield of claim 1 wherein said exhaust suction conduit is at an extended distance from said rotating disc edge portions.

7. A shield or dust-extracting device for powered, abrading machines comprising an upper or roof portion and a continuous skirt portion, said skirt portion having a substantially circular configuration and structured to encircle at least a portion of an abrading disc connected to a rotating arbor, said abrading disc having means when in contact with a surface to cause movement of contact-generated debris within said shield, said roof portion having a ring clamp with means for connection to an abrading machine, said ring clamp has a relatively large diameter and is position at an angle to and not parallel with a plane of a lower circular edge of said skirt, an exhaust suction conduit extending from an interior portion of said shield to suction-generating means, said skirt having a lower circular edge for holding flexible surface contact means, said ring clamp having adjusting means to facilitate connection to various size devices.

8. The shield of claim 7 wherein said ring clamp inclines downwardly from a horizontal plane at an angle of at least 5°.

9. The shield of claim 7 wherein said flexible surface contact means are at least two identical brush assemblies having substantially longer bristles for additional space coverage and protection against disc-generated debris.

10. The shield of claim 7 wherein said shield has an open front skirt portion for viewing a surface to disc contact, and a partial circular skirt portion encircling a portion of said abrading disc, said partial circular skirt portion having means to hold interchangeable brush assemblies that provide increased protection against debris escaping from the interior of said shield.

11. The shield of claim 7 wherein said shield contains a baffle extending downwardly from an interior portion of said shield at a location between said arbor back up pad and said exhaust suction conduit, said baffle forming a tunnel-like conduit to better transport debris from said disc to said exhaust suction conduit.

12. The shield of claim 7 wherein said exhaust suction conduit is at an extended distance from said rotating disc edge portions.

13. A dust guard or shield having means for connection to an abrading device, said shield comprising in combination an upper roof portion and a continuous skirt portion, said skirt portion having a substantially circular configuration and structured to encircle at least a portion of an abrading disc which is connected to a rotating vertical arbor, said abrading disc having means when in contact with a surface to cause movement of contact-generated debris within said shield, said roof portion having a ring clamp with means for connection to an abrading device, said ring clamp has a relatively large diameter and is positioned at an angle to and not parallel with a plane of a lower circular edge of said skirt, said ring clamp extending at an oblique angle relative to a surface to be treated, an exhaust suction conduit extending from an interior portion of said shield to suction-generating means and said skirt having a lower edge portion for holding in position substantially flexible bristle surface contact means.

14. The shield of claim 13 wherein said ring clamp inclines downwardly from a horizontal plane at an angle of at least 5°.

15. The shield of claim 13 wherein said flexible surface contact means are at least two identical brush assemblies having substantially longer bristles for additional space coverage and protection against disc-generated debris.

16. The shield of claim 13 wherein said shield has an open front skirt portion for viewing a surface to disc contact, and a partial circular skirt portion encircling a portion of said abrading disc, said partial circular skirt portion having means to hold interchangeable brush assemblies that provide increased protection against debris escaping from the interior of said shield.

17. The shield of claim 13 wherein said shield contains a baffle extending downwardly from an interior portion of said shield at a location between said arbor back up pad and said exhaust suction conduit, said baffle forming a tunnel-like conduit to better transport debris from said disc to said exhaust suction conduit.

18. The shield of claim 13 wherein said exhaust suction conduit is at an extended distance from said rotating disc edge portions.

* * * * *